US006732561B2

(12) United States Patent
Voges

(10) Patent No.: US 6,732,561 B2
(45) Date of Patent: May 11, 2004

(54) METHOD AND APPARATUS FOR LEVELING AND CONDITIONING SHEET METAL

(75) Inventor: Kevin Voges, Red Bud, IL (US)

(73) Assignee: The Material Works, Ltd., Red Bud, IL (US)

( * ) Notice: Subject to any disclaimer, the term of this patent is extended or adjusted under 35 U.S.C. 154(b) by 0 days.

(21) Appl. No.: 10/252,219

(22) Filed: Sep. 23, 2002

(65) Prior Publication Data

US 2004/0055350 A1 Mar. 25, 2004

(51) Int. Cl.[7] ..... B21D 1/05
(52) U.S. Cl. ..... 72/161; 72/205; 72/40
(58) Field of Search ..... 72/40, 160, 161, 72/205

(56) References Cited

U.S. PATENT DOCUMENTS

| | | | | | |
|---|---|---|---|---|---|
| 2,318,432 | A | * | 5/1943 | Stanier | 72/40 |
| 2,449,507 | A | | 9/1948 | Pope | |
| 2,907,151 | A | * | 10/1959 | Peterson | 451/55 |
| 3,686,921 | A | | 8/1972 | Roper | |
| 3,722,251 | A | | 3/1973 | Withrow | |
| 3,753,522 | A | | 8/1973 | Voges | |
| 3,924,428 | A | | 12/1975 | Noe | |
| 4,312,325 | A | | 1/1982 | Voges et al. | |
| 4,539,830 | A | | 9/1985 | Noe | |
| 4,751,838 | A | | 6/1988 | Voges | |
| 4,872,245 | A | | 10/1989 | Kawasaki | |
| 4,887,502 | A | | 12/1989 | Voges | |
| 4,982,593 | A | | 1/1991 | Holloway | |
| 5,077,887 | A | | 1/1992 | Holloway | |
| 5,181,411 | A | | 1/1993 | Holloway | |
| 5,579,658 | A | | 12/1996 | Noe | |
| 5,759,307 | A | | 6/1998 | Berger | |
| 5,820,704 | A | | 10/1998 | Veyer | |
| 5,829,287 | A | | 11/1998 | Noe | |
| 6,088,895 | A | * | 7/2000 | Nelson et al. | 72/40 |
| 6,089,063 | A | * | 7/2000 | Noe et al. | 72/39 |
| 6,205,830 | B1 | | 3/2001 | Voges | |
| 6,210,501 | B1 | * | 4/2001 | Okano et al. | 72/40 |

FOREIGN PATENT DOCUMENTS

| | | |
|---|---|---|
| DE | 1452957 | 4/1963 |
| EP | 0-498038 A2 | 8/1992 |
| JP | 58-116902 | 7/1983 |
| SU | 158862 | 11/1963 |

OTHER PUBLICATIONS

3M Scotch–Brite Product Brochure, 1993 (12 Pages).
Leveltek International, LLC website information, Circa 1999 (5 Pages).

* cited by examiner

*Primary Examiner*—Daniel C. Crane
(74) *Attorney, Agent, or Firm*—Thompson Coburn LLP

(57) ABSTRACT

A method of processing sheet metal comprises the steps of: providing a tension-leveling apparatus; providing a surface conditioning apparatus; leveling a portion of the sheet metal with the tension-leveling apparatus; and conditioning a surface of the portion of the sheet metal with the surface conditioning apparatus. The tension-leveling apparatus includes a first set of bridle rollers adapted to receive sheet metal from an upstream coil. The tension-leveling apparatus also includes a second set of bridle rollers downstream of the first set of bridle rollers. The tension-leveling apparatus is adapted to engage the sheet metal in a manner to subject the portion of the sheet metal between the first and second sets of bridle rollers to a tensile force. The step of leveling the portion of the sheet metal between the first and second sets of bridle rollers includes engaging that portion with the tension-leveling apparatus in a manner to flatten the portion and reduce internal residual stresses in that portion. The surface conditioning apparatus is located downstream of the first set of bridle rollers. The surface conditioning apparatus has at least one rotating conditioning member. The step of conditioning the surface of the portion of the sheet metal includes bringing the rotating conditioning member into engagement with the surface in a manner to remove scale from the surface.

7 Claims, 3 Drawing Sheets

METHOD AND APPARATUS FOR LEVELING AND CONDITIONING SHEET METAL

FIELD OF THE INVENTION

The present invention relates to flat rolled metal and sheet metal processing. More particularly, the present invention relates to a method and apparatus for leveling and conditioning sheet metal using a tension-leveling machine in combination with a surface conditioning system.

BACKGROUND OF THE INVENTION

A wide variety of manufactured goods contain processed sheet metal. For example, aircraft, automobiles, file cabinets and household appliances, to name only a few, contain sheet metal. The sheet metal is typically purchased directly from steel mills and/or steel service centers, but may be passed through intermediate processors (sometimes referred to as "toll" processors) before it is received by an original equipment manufacturer.

Various methods exist for flattening sheet metal and for conditioning the surfaces thereof. Flatness of sheet metal is important because virtually all stamping and blanking operations require a flat sheet. Also, in certain applications, such as in the aerospace industry, residual stress free material is critical. Good surface conditions are also important, especially in applications where the top and/or bottom surfaces of the metal sheet will be painted.

There are a number of common defects that effect sheet metal flatness. For example, when sheet metal is rolled into coil form for convenient storage and transportation, the strip takes on a coiled shape. This curvature is commonly referred to as "coil set." Coil set occurs because the sheet metal has been bent past its yield point. More specifically, when sheet metal is coiled, the metal fibers near the inside surface of the curved sheet are compressed past their yield point, and the metal fibers near the outside surface of the curved sheet are stretched past their yield point. Another type of shape defect known as "edge wave" occurs if the edge portions of the sheet are longer than the center portion of the sheet, resulting in undulations in one or both of the edge portions of the sheet. A similar type of shape defect known as "center buckle" results if the center portion of the sheet is longer than one or both of the edge portions, which results in bulging or undulating of the central portion of the sheet.

One proven method of leveling sheet metal is tension leveling. In general, a conventional tension leveling apparatus comprises a drag bridle, a pull bridle downstream from the drag bridle, and a tension leveler between the drag bridle and pull bridle. The drag and pull bridles each include a plurality of rollers that rotate to advance the metal sheet therethrough. The tension leveler located between the drag and pull bridles includes a plurality of smaller radius leveling rollers that are offset from one another to impart bending stresses in the metal sheet as the sheet is advanced therethrough. In operation, the metal sheet is unwound from an upstream "pay-off" reel and threaded through the aforementioned components of the tension leveling apparatus. Rollers of the pull bridle turn slightly faster than rollers of the drag bridle, so that the metal sheet is placed in substantial tension between the pull and drag bridles, while the metal sheet is passing through the leveling rollers. This tension is preferably sufficient to stretch all fibers in the metal sheet side-to-side and top-to-bottom. The effect of this tension is to cause all parts of the metal sheet between the drag and pull bridles, including the center fibers of the sheet, to exceed the material yield point as the metal sheet is made to conform to the smaller radius of the leveling rollers located between the drag and pull bridles. Tension levelers are also advantageous because, in general, they are faster than other types of leveling machines, such as stretcher levelers. Typically, tension levelers can handle between 150 and 1,500 linear feet of metal sheet per minute, depending on the gauge of the metal sheet (i.e., for heavier gauge, the linear speed will generally be lower than for lighter gauge), and typically as much as 72" in width. While such tension levelers have proven to be effective in leveling sheet metal, even in a coil-to-coil operation, a tension leveling apparatus alone does nothing to improve the surface quality of the sheet metal.

Thus, there is a need for a sheet metal processing apparatus that incorporates the benefits of a tension leveler together with a surface conditioning apparatus that removes scale and other smut from the surface in a continuous strip of sheet metal.

SUMMARY OF THE INVENTION

It is a principal object of the present invention to provide a method and apparatus for processing sheet metal which benefits from the synergy of combining a tension-leveling machine and an adjacent surface conditioner, whereby the performance of the surface conditioner is improved at least in part due to its location relative to the various components of the tension-leveling machine, and also due to the fact that the tension leveling is a continuous operation. A related object is to provide a method and apparatus for processing sheet metal that incorporates the benefits of a tension-leveling machine, for flattening the metal sheet and for reducing or eliminating internal residual stresses in the sheet metal, and also incorporates the benefits of a surface conditioning process that employs abrasive, rotating cleaning brushes, which are brought into engagement with the surface of the sheet metal to remove scale and other smut from the surface. Another object of the invention is to provide a sheet metal processing apparatus that incorporates a tension leveler and a surface conditioning process together in-line to reduce material handling costs. Still another object is to provide a metal processing apparatus that is capable of flattening as well as reducing or eliminating internal residual stresses from sheet metal in a coil-to-coil processing operation. A further object of the invention is to provide a sheet metal processing apparatus that is easier and more economical to run than conventional temper mills. Still another object is to provide a metal processing apparatus that is capable of providing superior flatness, even in severely deformed metal coils, and conditioning the surface, thus making the finished product more marketable.

In general, a method of the present invention for processing sheet metal comprises the steps of: providing a tension-leveling apparatus; providing a surface conditioning apparatus; engaging a portion of the sheet metal with the tension-leveling apparatus; and conditioning a surface of the portion of the sheet metal with the surface conditioning apparatus. The tension-leveling apparatus includes a first set of bridle rollers adapted to receive sheet metal from an upstream coil. The tension-leveling apparatus also includes a second set of bridle rollers downstream of the first set of bridle rollers. The tension-leveling apparatus is adapted to engage the sheet metal in a manner to subject the portion of the sheet metal between the first and second sets of bridle rollers to a tensile force that is sufficient to flatten the portion of the metal sheet. The surface conditioning apparatus is located downstream of the first set of bridle rollers. The surface conditioning apparatus has at least one rotating conditioning member. The step of conditioning the surface of the portion of the sheet metal includes bringing the rotating conditioning member into engagement with the surface in a manner to remove scale from the surface.

In another aspect of the present invention, a method of leveling and surface-conditioning sheet metal, in line, in a continuous coil-to-coil processing operation, comprises the steps of: providing a tension-leveling apparatus; providing a surface conditioning apparatus adjacent to the tension-leveling apparatus; advancing a continuous length of sheet metal from an upstream coil through the tension-leveling apparatus; applying a tensile force to a portion of the sheet metal between the first and second sets of bridle rollers; leveling the portion of the sheet metal between the first and second sets of bridle rollers; directing the continuous length of sheet metal through the surface conditioning apparatus; and conditioning a surface of the sheet metal with the surface conditioning apparatus. In this aspect of the invention, the tension-leveling apparatus includes a first set of bridle rollers, a second set of bridle rollers downstream of the first set of bridle rollers, and a set of leveling rollers between the first and second sets of bridle rollers. The step of advancing the continuous length of sheet metal through the tension-leveling apparatus includes advancing the continuous length of sheet metal through the first set of bridle rollers, through the set of leveling rollers and through the second set of bridle rollers. The tensile force applied to the portion of the sheet metal between the first and second sets of bridle rollers is applied continuously to that portion by the first and second sets of bridle rollers as the sheet metal is advanced. The step of leveling the portion of the sheet metal between the first and second sets of bridle rollers is accomplished by bringing the set of leveling rollers into engagement with the sheet metal in a manner so that the portion of the sheet metal is made to conform to the leveling rollers while being subjected to the tensile force. The surface conditioning apparatus is positioned in line with the tension-leveling apparatus and downstream of the first set of bridle rollers. The surface conditioning apparatus has at least one rotating conditioning member. The step of directing the continuous length of sheet metal through the surface conditioning apparatus is performed as the continuous length of sheet metal is advanced through the first and second sets of bridle rollers. The step of conditioning the surface of the sheet metal is accomplished by bringing the rotating conditioning member into engagement with the surface of the sheet metal in a manner to remove scale therefrom.

In still another aspect of the invention, a metal processing apparatus comprises a tension-leveling apparatus and an adjacent surface conditioning apparatus. The tension-leveling apparatus is adapted to receive a continuous length of sheet metal from an upstream coil. The tension-leveling apparatus has a first set of bridle rollers, a second set of bridle rollers downstream of the first set of bridle rollers, and a set of leveling rollers between the first and second sets of bridle rollers, the first and second sets of bridle rollers. The first and second sets of bridle rollers are adapted to engage the sheet metal in a manner to subject a portion of the sheet metal between the first and second sets of bridle rollers to a first tensile force. The set of leveling rollers is adapted to engage the portion of the sheet metal between the first and second sets of bridle rollers in a manner so that the portion is made to conform to surfaces of the leveling rollers while subjected to the tensile force. The surface conditioning apparatus is located downstream of the first set of bridle rollers of the tension-leveling apparatus. The surface conditioning apparatus has at least one rotating conditioning member, which is adapted for engagement with a surface the sheet metal in a manner to remove scale from the surface.

Other objects and features of the invention will be in part apparent and in part pointed out hereinafter. While the principal advantages and features of the present invention have been described above, a more complete and thorough understanding and appreciation for the invention may be attained by referring to the drawings and description of the preferred embodiments, which follow.

Figure 1:
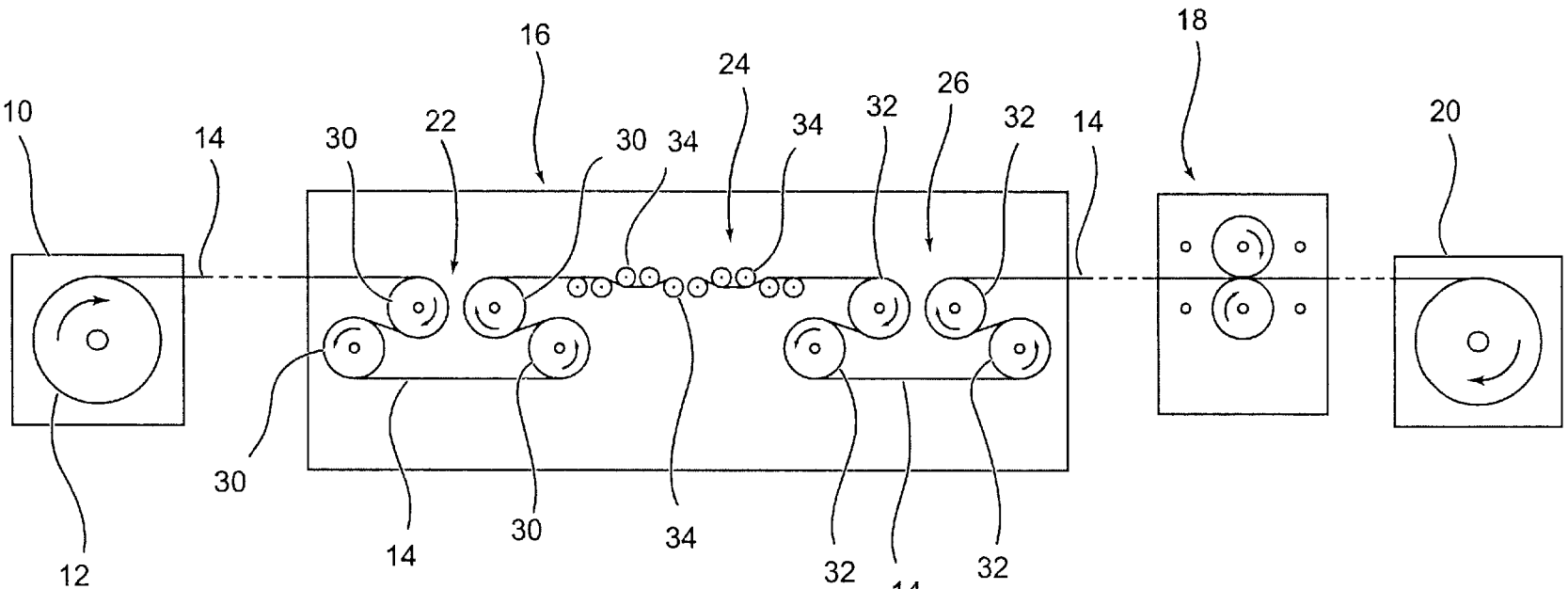
FIG. 1 is schematic representation of an in-line metal processing system of the present invention, the metal processing system being illustrated with other apparatus with which it may be used.

Reference characters shown in these Figures correspond to reference characters used throughout the following detailed description of the preferred embodiments.

DETAILED DESCRIPTION OF THE PREFERRED EMBODIMENTS

One preferred embodiment of an in-line metal processing apparatus of the present invention is shown generally in FIG. 1. In general, FIG. 1 shows an upstream "pay-off" reel 10, a coil 12 of sheet metal 14 mounted to the reel 10, a tension leveling apparatus 16, a surface conditioning apparatus 18, and a downstream take-up reel 20. In general, the tension leveling apparatus 16 comprises a drag bridle 22, a leveler 24, and a pull bridle 26. The "pay-off" reel 10 and take-up reel 20 are conventional.

As shown in FIG. 1, the drag bridle 22 includes a plurality of drag rollers 30, which receive the metal sheet from the upstream "pay-off" reel 10. The pull bridle 26 includes a plurality of pull rollers 32. The rollers of the drag and pull bridles 22 and 26 are powered, as is well known in the art, and rotate to advance the metal sheet through the tension leveler 16. The leveler 24 is located between the drag and pull bridles 22 and 26 and includes a plurality of smaller radius leveling rollers 34, which are offset from one another to impart bending stresses in the metal sheet 14 as the sheet is advanced therethrough. The pull rollers 32 of the pull bridle 26 turn slightly faster than the drag rollers 30 of the drag bridle 22. Thus, the portion of the metal sheet 14 between the drag and pull bridles 22 and 26 is placed under a substantial tensile force. This tensile force is preferably sufficient to stretch all fibers in the metal sheet 14 side-to-side and top-to-bottom. The effect of this tension is to cause all parts of the metal sheet 14 between the drag and pull bridles 22 and 26, including center fibers of the sheet, to exceed the material yield point as the metal sheet 14 is made to conform to the smaller radius of the leveling rollers 34 located between the drag and pull bridles 22 and 26, as the metal sheet 14 passes through the leveling rollers 34.

With continued reference to the embodiment of FIG. 1, the surface conditioning apparatus 18 is located just downstream of the tension leveling apparatus 16. As explained below in more detail, the surface conditioning apparatus 18 includes at least one abrasive, rotating cleaning brush (shown in FIGS. 3 and 4). The brush is brought into engagement with a surface of the sheet metal strip 14 to remove scale and other smut from the surface. Preferably, a coolant and/or lubricant, such as water, is applied to the brush during the cleaning operation to produce a cooler running operation, to wash away cleaning by-products, and to extend the life and effectiveness of the brush. As explained hereinafter, the performance of the surface conditioner 18 is enhanced by its location downstream of the tension leveling apparatus 16.

In operation, the metal sheet 14 is unreeled from the pay-off reel 10 and "threaded" through the drag rollers 30 of the drag bridle 22, then through the leveling rollers 34 of the leveler 24, and then through the pull rollers 32 of the pull bridle 26, as shown in FIG. 1. The powered bridle rollers 22 and 26 advance the metal sheet 14 through the apparatus, with the pull rollers 32 turning slightly faster than the drag rollers 30 so that the portion of the metal sheet 14 between the drag and pull bridles 22 and 26 is placed under the tensile force, while the metal sheet 14 is also made to conform to the smaller radius of the leveling rollers 34. Leveled metal sheet 14 exiting from the downstream end of the tension leveling apparatus 16 is then received by the surface conditioner 18, which conditions the surface of the metal sheet (as described below) while the metal sheet 14 is advanced therethrough. Finally, the leveled and conditioned metal sheet 14 is re-coiled by the take-up reel 20.

Figure 2:
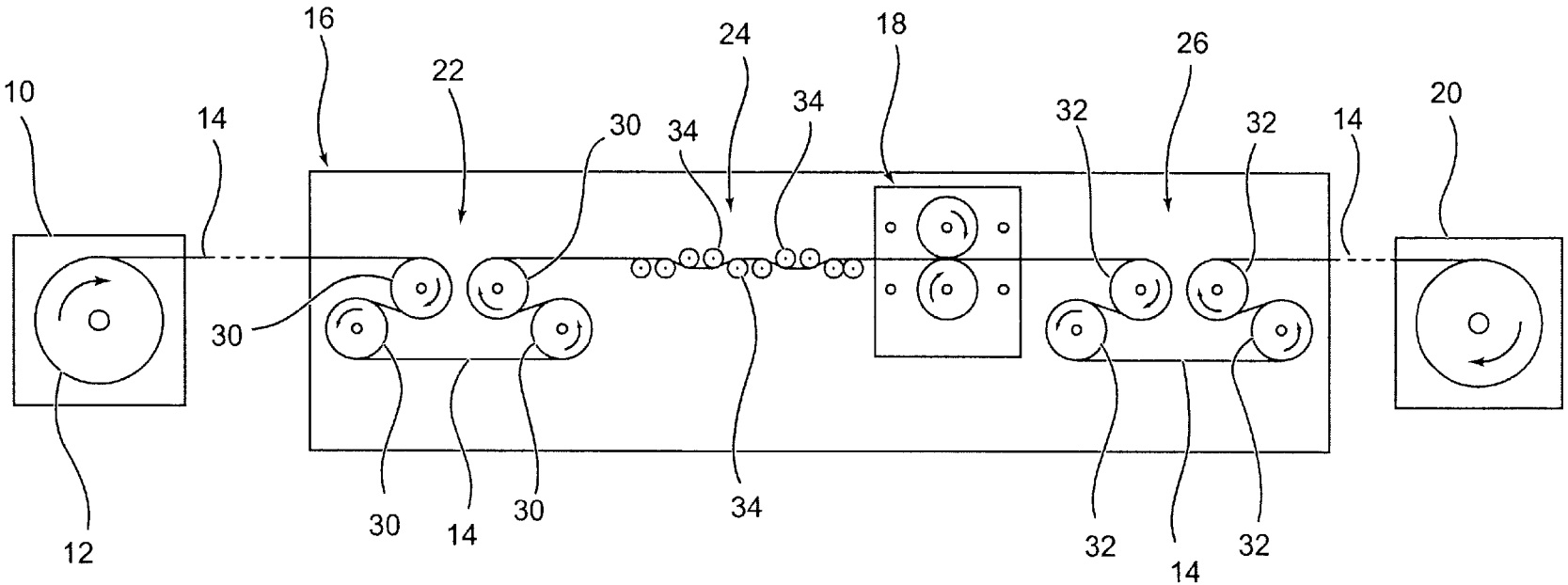
FIG. 2 is schematic representation of a second embodiment of an in-line metal processing system of the present invention, also illustrated with other apparatus with which it may be used.

Another preferred embodiment of an in-line metal processing apparatus of the present invention is shown generally in FIG. 2. Like the apparatus of FIG. 1, the apparatus of FIG. 2 includes an upstream "pay-off" reel 10, a coil 12 of sheet metal 14 mounted to the reel 10, a tension leveling apparatus 16, a surface conditioning apparatus 18, and a downstream take-up reel 20. Again, the tension leveling apparatus 16 comprises a drag bridle 22, a leveler 24, and a pull bridle 26, and these components function in essentially the same manner as the corresponding components of the embodiment of FIG. 1, as described above. However, in the embodiment of FIG. 2, the surface conditioning apparatus 18 is located between the leveler 24 and a pull bridle 26, rather than downstream of the pull bridle 26 as shown in FIG. 1. As explained hereinafter, the performance of the surface conditioner 18 of this embodiment is particularly enhanced by its location relative to the various components of the tension leveling apparatus 16. Aside from the different location of the surface conditioner 18 relative to the components of the tension leveling apparatus 16, the embodiment of FIG. 2 is generally similar to the embodiment of FIG. 1.

Figure 3:
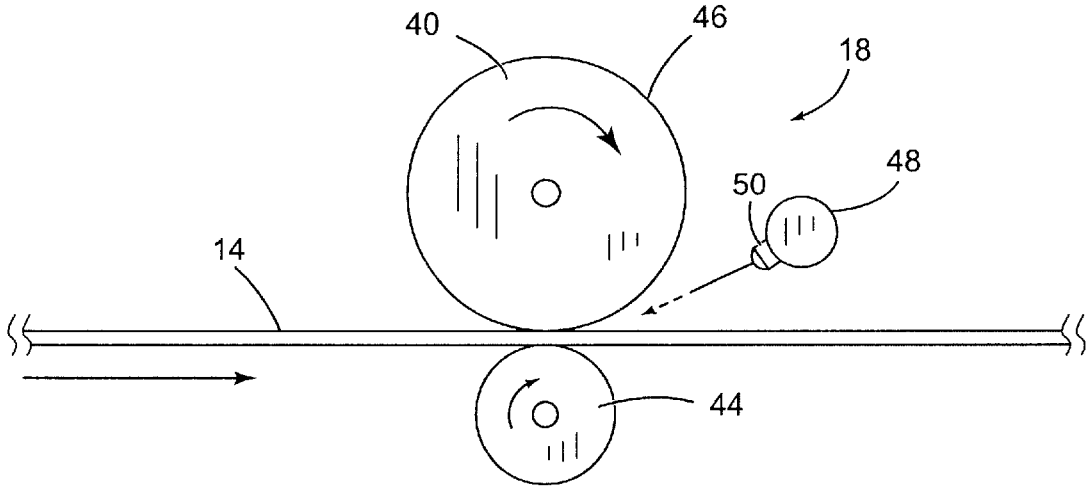
FIG. 3 is a side elevational view of the surface conditioning component of the in-line metal processing system of the present invention.
Figure 4:
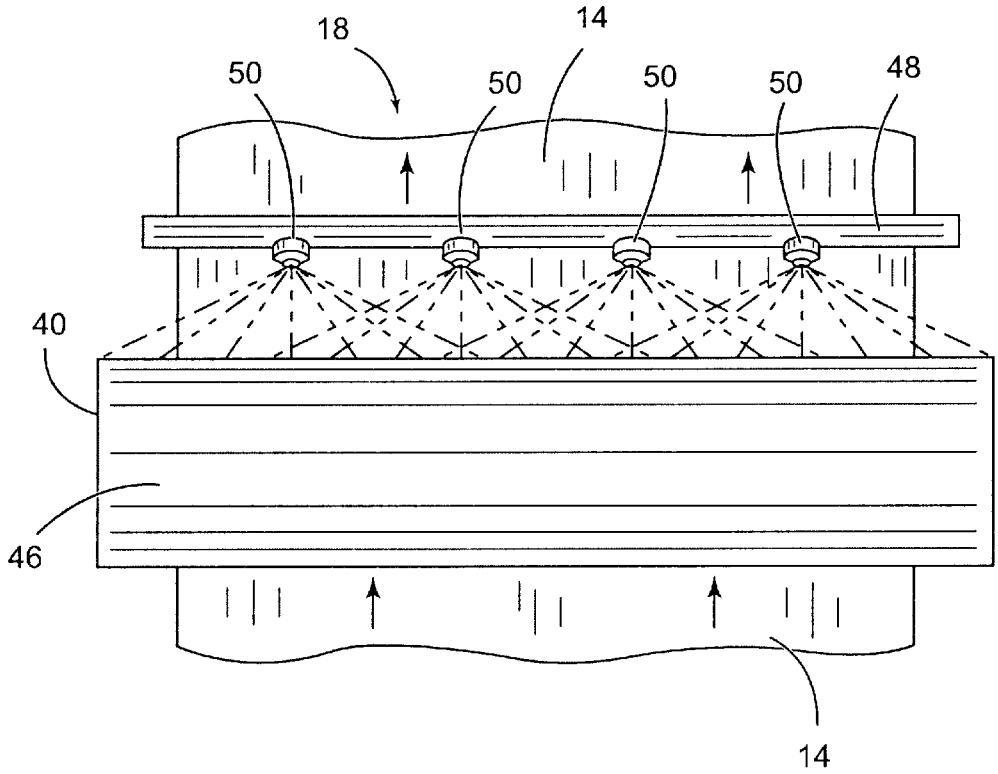
FIG. 4 is a top plan view of the surface conditioning apparatus.

FIG. 3 is an enlarged view of key components of the surface conditioner 18. FIG. 4 is a top plan view of the surface conditioner 18. As shown in FIGS. 3 and 4, the surface conditioner 18 includes a rotating cleaning brush 40, a plurality of coolant/lubricant sprayers 42, and a back-up roller 44. The cleaning brush 40 includes a mildly abrasive conditioning surface 46 having a generally cylindrical configuration.

Cleaning brushes manufactured by Minnesota Mining and Manufacturing (3M) under the name Scotch-Brite®, or their equivalent, are suitable for use in the surface conditioner 18 of the present invention. In these brushes, abrasive particles are bonded to synthetic (e.g., nylon) fibers of the brush with a resin adhesive. The brush fibers of the Scotch-Brite® product are of an open-web construction, which gives the fibers a spring-like action that conforms to irregular surfaces and prevents surface gouging. Scotch-Brite® brand cleaning brushes are available in a variety of grades of coarseness and fiber density, though suitable cleaning brushes manufactured by others could be used without departing from the scope of the present invention. Selection of the proper grade will depend on the particular cleaning or finishing application, and is well within the skill of one of ordinary skill in the art.

As shown in FIG. 3, the cleaning brush 40 is preferably positioned above the sheet metal strip 14 for engagement with the top surface thereof. Preferably, the cleaning brush 40 is rotated in a direction against the movement of the strip through the surface conditioner 18 (clockwise as viewed in FIG. 3, with the strip 14 advancing from left to right). The back up roller 44 engages against the bottom surface of the strip 14 opposite the cleaning brush 40 and applies an upward force equal and opposite to the downward force applied by the cleaning brush 40. Preferably, the back up roller 44 moves in the same direction as the strip 14 (clockwise as viewed in FIG. 3). The back up roller 44 may be powered to assist in advancing the strip 14 through the surface conditioner 18. Although the present invention has been described as having one cleaning brush positioned for engagement with the top surface of the strip 14, additional brushes positioned for engagement with the upper and/or lower surfaces of the strip could be used without departing from the scope of the invention.

Preferably, a spray bar 48 having a plurality of sprayer nozzles 50 is positioned just downstream of the cleaning brush 40, with the sprayer nozzles 50 aimed generally toward the point of engagement of the cleaning brush 40 and the top surface of the strip 14. The sprayer nozzles 50 apply a coolant/lubricant, such as water, to the cleaning brush 40 during operation of the surface conditioner 18. Preferably, the coolant/lubricant is applied at the rate of about 4 to 6 gallons per minute per 12" length of the cleaning brush 40. This enhances performance of the surface conditioner 18 by producing a cooler running operation, by washing away cleaning by-products (scale and smut removed by the abrasive surface of the brush), and by extending the life of the cleaning brush 40. As shown in FIG. 4, the spray nozzles 50 are preferably positioned to apply the coolant/lubricant in an overlapping spray pattern so that, if one of the nozzles gets plugged, adjacent nozzles can maintain substantially complete coverage. While the spray bar 48 positioned just downstream of the cleaning brush 40 is important for proper performance, additional spray bars (not shown) may be added at other locations upstream and downstream of the cleaning brush 40 and back up roller 44.

To be effective, the surface conditioner 18 requires a very flat surface. While 3M Scotch-Brite® type cleaning brushes have been used for cleaning smut from the rollers used in temper passing processes, they have not been used to condition the surface of heavy gauge sheet metal. This is because it has been found that roller leveling and temper passing processes do not achieve sufficient flatness for this type of surface conditioning process especially when heavy gauge metal sheet is being processed. However, the combination of the tension leveling apparatus 16 and surface conditioning apparatus 18 form a synergy, whereby the performance of the surface conditioning apparatus 18 is improved due to its location relative to the various components of the tension leveling apparatus 16.

With respect to the embodiment of FIG. 1, where the surface conditioning apparatus 18 is located downstream of the pull bridle 26 of the tension leveling apparatus 16, metal sheet 14 exiting the tension leveling apparatus 16 is in an extremely flat condition, substantially free of coil set and other deformities caused by internal residual stresses. In this condition, the metal sheet 14 is suitable for effective use in the surface conditioning apparatus. Again, the tension applied to the metal sheet by the drag and pull bridles 22 and 26 of the tension leveling apparatus 16 is substantial and stretches all fibers of the metal sheet 14, including center fibers of the sheet, past the material yield point. This occurs while the metal sheet 14 is made to conform to the small diameter leveler rollers 34, such that internal residual stresses in the metal sheet are reduced or eliminated and the sheet is substantially flattened. Once these internal residual stresses and associated deformities are sufficiently reduced, the metal sheet is in an extremely flat condition suitable for effective use in the surface conditioning apparatus. Another advantage of locating the surface conditioner 18 after the pull bridle 26 is that leader strip waste is minimized.

With respect to the embodiment of FIG. 2, where the surface conditioning apparatus 18 is located between the leveling rollers 34 and the pull bridle 26, the surface conditioning apparatus 18 engages the metal sheet 14 while it is subjected to the tensile force between the drag and pull bridles 22 and 26. Again, this tension is substantial and stretches all fibers of the metal sheet 14, including center fibers of the sheet, past the material yield point, such that internal residual stresses in the metal sheet are reduced or eliminated and the sheet is substantially flattened. However, once the metal sheet 14 advances past the pull bridle 26, it is no longer in tension. Thus, in this embodiment, the surface conditioning apparatus 18 engages the metal sheet 14 when the metal sheet is in its flattest condition (i.e., while it is under the substantial tensile force imparted by the drag and pull bridles 22 and 26). While under tension, the metal sheet 14 is in an extremely flat condition that is ideal for best performance of the surface conditioning apparatus 18. While under tension, the metal sheet 14 is never flatter, though locating the surface conditioner 18 between the leveler 24 and the pull bridle 26 will require some amount of leader during set up, which will not be cleaned by the surface conditioner 18.

Another advantage of using a tension leveler in combination with the surface conditioner 18 is that tension leveling is a continuous operation, i.e., the metal sheet 14 advances through the system at a substantially constant speed during the operation, without interruption. This is beneficial because, when such surface conditioners are used with intermittent leveling techniques (e.g., stretcher leveling where advancement of the metal sheet stops and starts with each successive stretching operation), the cleaning brushes 40 may leave burnish marks on the surface of the metal sheet while the advancement of the sheet is temporarily halted between successive stretching operations. These marks are difficult to remove and are generally unattractive to customers. Because tension leveling is a continuous operation, the cleaning brushes 40 of the surface conditioner 18 engage the surface of the metal sheet 14 consistently and uniformly throughout the leveling process.

While the present invention has been described by reference to specific embodiments and specific uses, it should be understood that other configurations and arrangements could be constructed, and different uses could be made, without departing from the scope of the invention as set forth in the following claims.

What is claimed is:

1. A method of processing sheet metal comprising the steps of:

providing a tension-leveling apparatus including a first set of bridle rollers adapted to receive sheet metal from an upstream coil and a second set of bridle rollers downstream of the first set of bridle rollers, the tension-leveling apparatus also including a set of leveling rollers between the first and second sets of bridle rollers;

providing a surface conditioning apparatus having at least one rotating conditioning member located between the set of leveling rollers and the second set of bridle rollers;

engaging the sheet metal with the tension-leveling apparatus in a manner to subject a portion of the sheet metal between the first and second sets of bridle rollers to a tensile force that is sufficient to flatten the portion of the metal sheet, the engaging including leveling the portion of the sheet metal between the first and second sets of bridle rollers by engaging said portion with the leveling rollers in a manner so that the portion of the sheet metal is made to conform to surfaces of the leveling rollers while being subjected to the tensile force, thereby reducing internal residual stresses in said portion; and conditioning a surface of the portion of the sheet metal with the surface conditioning apparatus by bringing the at least one rotating conditioning member into engagement with the surface of the portion of the sheet metal in a manner to remove scale from the surface.

2. A method of leveling and surface-conditioning sheet metal, in line, in a continuous coil-to-coil processing operation, the method comprising the steps of:

providing a tension-leveling apparatus including a first set of bridle rollers, a second set of bridle rollers downstream of the first set of bridle rollers, and a set of leveling rollers between the first and second sets of bridle rollers;

providing a surface conditioning apparatus having at least one rotating conditioning member located between the first set of bridle rollers and the second set of bridle rollers;

advancing a continuous length of sheet metal from an upstream coil through the first set of bridle rollers, through the set of leveling rollers and through the second set of bridle rollers;

applying a continuous tensile force to a portion of the sheet metal between the first and second sets of bridle rollers of the tension-leveling apparatus;

leveling the portion of the sheet metal between the first and second sets of bridle rollers by bringing the set of leveling rollers into engagement with said portion in a manner so that the portion of the sheet metal is made to conform to the leveling rollers while being subjected to the tensile force;

directing the continuous length of sheet metal through the surface conditioning apparatus, as the continuous length of sheet metal is advanced through the first and second sets of bridle rollers; and conditioning a surface of the continuous length of sheet metal with the surface conditioning apparatus by bringing the at least one rotating conditioning member into engagement with the surface in a manner to remove scale from the surface.

3. The method of claim 2 wherein the surface conditioning apparatus is located between the set of leveling rollers and the second set of bridle rollers.

4. A metal processing apparatus comprising:

a tension-leveling apparatus adapted to receive a continuous length of sheet metal from an upstream coil, the tension-leveling apparatus having a first set of bridle rollers, a second set of bridle rollers downstream of the first set of bridle rollers, and a set of leveling rollers between the first and second sets of bridle rollers, the first and second sets of bridle rollers being adapted to engage the sheet metal in a manner to subject a portion of the sheet metal between the first and second sets of bridle rollers to a tensile force, the set of leveling rollers being adapted to engage the portion of the sheet metal between the first and second sets of bridle rollers in a manner so that the portion is made to conform to surfaces of the leveling rollers while subjected to the tensile force, whereby internal residual stresses in said portion are reduced; and a surface conditioning apparatus having at least one rotating conditioning member located between the first set of bridle rollers and the second set of bridle rollers that is adapted for engagement with a surface the sheet metal in a manner to remove scale from the surface.

5. The apparatus of claim 4 wherein the surface conditioning apparatus is located between the set of leveling rollers and the second set of bridle rollers.

6. An assembly comprising:

a length of sheet metal;

a tension-leveling apparatus, the tension-leveling apparatus having a first set of bridle rollers, a second set of bridle rollers, and a set of leveling rollers, the first and second sets of bridle rollers being engaged with the length of sheet metal in a manner tensioning a portion of the length of sheet metal that extends from the first set of bridle rollers to the second set of bridle rollers, the set of leveling rollers being engaged with the portion of the length of sheet metal in a manner forcing the portion of the length of sheet metal to be bent in opposite directions; and at least one rotating conditioning member engaged with the portion of the length of sheet metal.

7. An assembly in accordance with claim 6 wherein a first part of the portion of the length of sheet metal that extends from where the leveling rollers engage the portion of the length of sheet metal to where the second set of bridle rollers engage the portion of the length of sheet metal is generally flatter than a second part of the portion of the length of sheet metal that extends from where the first set of bridle rollers engage the portion of the length of sheet metal to where the leveling rollers engage the portion of the length of sheet metal, and wherein the rotating conditioning member is engaged with the first part of the portion of the length of sheet metal.

* * * * *